US011333463B2

(12) United States Patent
Flores

(10) Patent No.: US 11,333,463 B2
(45) Date of Patent: May 17, 2022

(54) MODULAR FIREARM HOLSTER SAFETY RETENTION ASSEMBLY AND METHOD OF OPERATION

(71) Applicant: U.S. DUTY GEAR, INC., Ontario, CA (US)

(72) Inventor: Jose Luis Flores, Ontario, CA (US)

(73) Assignee: U.S. DUTY GEAR, INC., Ontario, CA (US)

( * ) Notice: Subject to any disclaimer, the term of this patent is extended or adjusted under 35 U.S.C. 154(b) by 0 days.

(21) Appl. No.: 17/331,255

(22) Filed: May 26, 2021

(65) Prior Publication Data

US 2021/0372734 A1 Dec. 2, 2021

Related U.S. Application Data

(60) Provisional application No. 63/030,247, filed on May 26, 2020.

(51) Int. Cl.
*F41C 33/02* (2006.01)

(52) U.S. Cl.
CPC ..... *F41C 33/0272* (2013.01); *F41C 33/0245* (2013.01); *F41C 33/0263* (2013.01)

(58) Field of Classification Search
CPC .. F41C 33/02; F41C 33/0263; F41C 33/0245; F41C 33/0272
USPC ..... 224/243
See application file for complete search history.

(56) References Cited

U.S. PATENT DOCUMENTS

| | | | | |
|---|---|---|---|---|
| 8,925,773 | B2 * | 1/2015 | Clifton | F41C 33/0209 224/198 |
| 11,054,214 | B2 * | 7/2021 | Pellegrini | F41C 33/0263 |
| 2006/0157520 | A1 * | 7/2006 | Clifton, Jr. | F41C 33/0245 224/193 |
| 2007/0181619 | A1 * | 8/2007 | Seyfert | F41C 33/0227 224/912 |
| 2009/0294496 | A1 * | 12/2009 | Gallagher | F41C 33/0209 224/243 |
| 2010/0176165 | A1 * | 7/2010 | Lowe | F41C 33/0209 224/191 |
| 2011/0174849 | A1 * | 7/2011 | Clifton, Jr. | F41C 33/0263 224/243 |
| 2014/0042196 | A1 * | 2/2014 | Pellegrini | F41C 33/0263 224/243 |

* cited by examiner

*Primary Examiner* — Corey N Skurdal
(74) *Attorney, Agent, or Firm* — Elizabeth Yang

(57) ABSTRACT

A modular firearm holster safety retention assembly is operable with a holster to prevent unauthorized extraction or accidental drop of a firearm from holster. The assembly comprises a saddle that receives the barrel of a firearm, and a pivot release arm that couples to the saddle to selectively restrict movement or release the firearm in the holster. The pivot release arm detachably couples to the saddle. The pivot release arm has a first end with a protruding locking nub that engages the ejection port of firearm to restrict movement thereof; and a second end that is urged away from the saddle to disengage the locking nub from the firearm ejection port to disengage firearm from saddle. The saddle and the pivot release arm have interlocking wedges that restrict forceful removal of the firearm from holster. The saddle has a pivot stop to prevent overleveraging of pivot release arm.

6 Claims, 5 Drawing Sheets

MODULAR FIREARM HOLSTER SAFETY RETENTION ASSEMBLY AND METHOD OF OPERATION

CROSS-REFERENCE TO RELATED APPLICATIONS

This non-provisional application claims priority under 35 U.S.C. § 119(a) on U.S. Provisional Patent Application No(s). 63/030,247 filed on May 26, 2020, the entire contents of which are hereby incorporated by reference.

FIELD OF THE INVENTION

The present invention relates generally to a modular firearm holster safety retention assembly and method of operation. More so, the firearm holster safety assembly is operable with a gun holster to prevent the unauthorized extraction or accidental drop of the firearm from the holster; whereby the holster safety assembly is a modular design comprising a saddle that is shaped to receive the barrel of a specific firearm, and a pivot release arm that detachably couples to the saddle and is configured with a first end having a locking nub that engages the ejection port of the firearm to restrict movement thereof, and a second end that is urged away from the saddle to disengage the locking nub from the firearm ejection port, so as to disengage the firearm from the saddle; whereby the saddle and the pivot release arm have interlocking wedges that restrict forceful removal of the firearm while fitted into the saddle through a braking mechanism; whereby the saddle has a pivot stop to prevent overleveraging of the pivot release arm; and whereby the modular configuration allows for accommodating different types and sizes of firearms.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

In the United States, gun protection and safety have become a necessity. Common custom holsters, which are mainly worn with a belt and fixed on the thigh side or waist, and the holster is comprising a bag body and a belt buckle. In order to prevent the gun from falling out, the body is generally provided with a buckle strap for crimping the buckle, so that the gun can be enclosed in a bag after crimping. However, the main disadvantage of this type of holster is that it is prone to accidental shots or easy to be snatched. The criminals can easily pull out the gun by unfastening the buckle. Many male and female police officers were killed by their own guns after they were disarmed by an increasing number of violent criminals, which is quite dangerous. In order to adapt to these important realities, it is necessary to provide holsters that can ensure that guns will not be taken away and will not be used by children and others.

SUMMARY OF THE INVENTION

Illustrative embodiments of the disclosure are generally directed to a spring exercise system and method of exercising which allows a user to perform a low-impact system of exercise that utilizes a non-fixed spring with multiple resistance levels that extends, and is stretchable between multiple interchangeable grasp handles and loops that are graspable with different combinations of the hands, feet, arms, ankles and legs; whereby the spring generates an extension of resistance that strengthens the small and long muscles, enhances flexibility, and emphasizes proper postural alignment, core strength, and muscle balance.

In order to solve the problem above, the present invention provides a modular firearm holster safety retention assembly, which can lock a firearm in place when inserted into a holster.

The assembly comprising:

a saddle comprising:

two sidewalk joined together by a pair of spaced-apart bridges, the walls and the bridges being shaped and dimensioned to form a barrel passageway to receive a barrel of a firearm, whereby an ejection port of the firearm is disposed between the bridges;

a pivot stop disposed at one of the bridges;

a pair of saddle wedges formed in the sidewalk;

a pivot release arm detachably attachable to the saddle, the pivot release arm comprising:

a first end and a second end, the first end comprising a platform coupled between the bridges of the platform, the platform comprising a locking nub that aligns with and engages the ejection port of the firearm when the barrel sets in the barrel passageway, whereby the locking nub restricts the barrel of the firearm from disengaging from the barrel passageway, the second end projecting away from the platform, whereby urging the second end of the pivot release arm to pivot away from the platform disengages the locking nub from the ejection port of the firearm to enable the barrel of the firearm to disengage from the barrel passageway;

whereby the pivot stop of the saddle restricts the pivot distance of the pivot release arm; and a pair of arm wedges formed in the first end of the pivot release arm, adjacent to the platform, whereby the saddle wedge and the arm wedge engage when a torque is applied to the second end of the pivot release arm.

In another aspect, the bridges are defined by a central hole that aligns with a fastening hole in the central axis of the bridges.

In another aspect, the platform is defined by a central fastening hole.

In another aspect, the present invention further comprising a T-nut and a screw that pass through the fastening holes in the bridge and the platform.

In another aspect, the assembly is sized to retain multiple sizes and types of firearms.

In another aspect, the assembly is fabricated from a Nylon Resin.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

Figure 1:
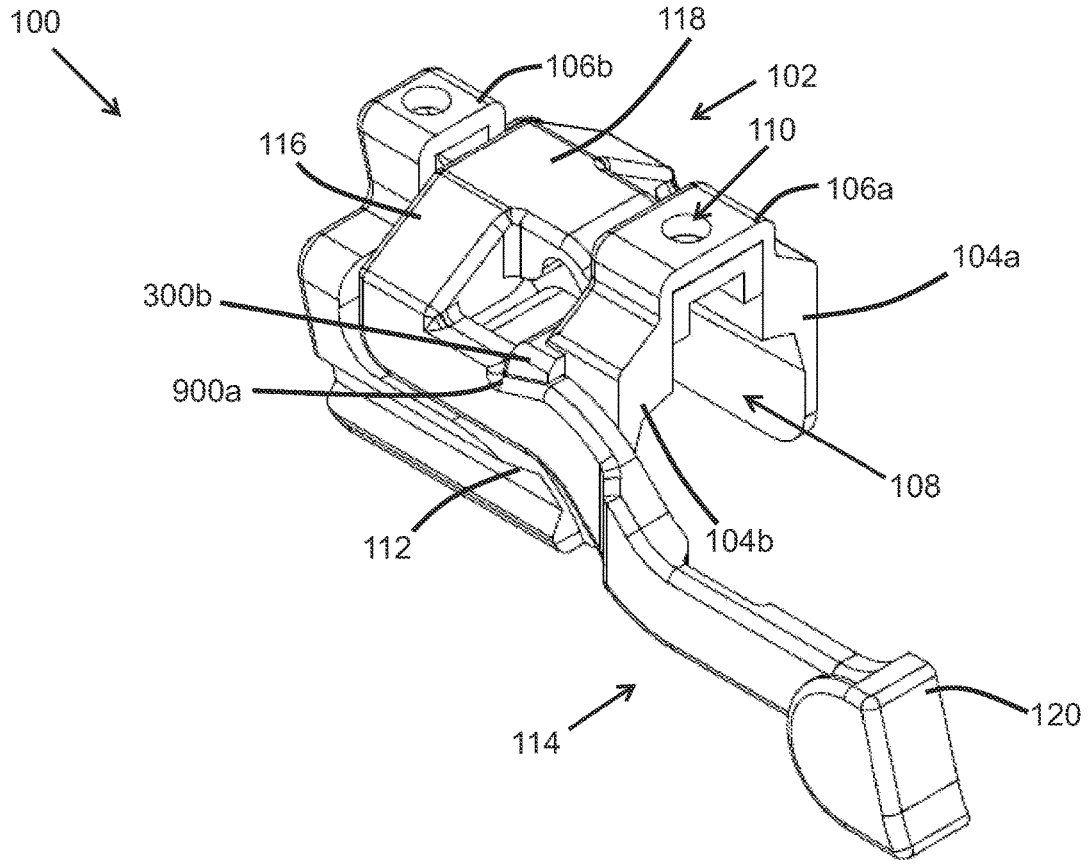
FIG. 1 illustrates a right-side isometric view of an exemplary modular firearm holster safety retention assembly, in accordance with an embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific assemblies and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

At the outset, it should be clearly understood that like reference numerals are intended to identify the same structural elements, portions, or surfaces consistently throughout the several drawing figures, as may be further described or explained by the entire written specification of which this detailed description is an integral part. The drawings are intended to be read together with the specification and are to be construed as a portion of the entire "written description" of this invention as required by 35 U.S.C. § 112.

In one embodiment of the present invention presented in FIGS. 1-12, a modular firearm holster safety retention assembly 100 and method of operation is operable with a gun holster to prevent the unauthorized extraction or accidental drop of a firearm from the holster. The modular configuration, combining a saddle 102 with a pivot release arm 114, allows for accommodating different types and sizes of firearms. The modular firearm holster safety retention assembly 100, hereafter "assembly 100" comprises a saddle 102 that receives a firearm, and a pivot release arm 114 that couples to the saddle 102 in order to selectively restrict movement of the firearm in the holster, and release the firearm from the holster.

As FIG. 1 illustrates, the assembly 100 has a two-piece a modular design comprising a saddle 102 that is shaped to receive the barrel of a specific firearm, and a pivot release arm 114 that detachably couples to the saddle 102. The pivot release arm 114 is defined by a first end 116 having a protruding locking nub 1000 that engages the ejection port of the firearm to restrict movement thereof; and a second end 120 that is urged away from the saddle 102 to disengage the locking nub 1000 from the firearm ejection port, so as to disengage the firearm from the saddle 102. The saddle 102 and the pivot release arm 114 have interlocking wedges that restrict forceful removal of the firearm while fitted into the saddle 102 through a braking mechanism. The saddle 102 has a pivot stop 112 to prevent overleveraging of the pivot release arm 114 while being urged away from the saddle 102 to release the locking nub 1000. Once the locking nub 1000 disengages, the firearm is free to be removed from holster and saddle. Other alternatively architectural arrangements are known to the inventor. For example, the assembly 100 can also be constructed by three or more pieces, not limiting into two-piece.

Figure 2:
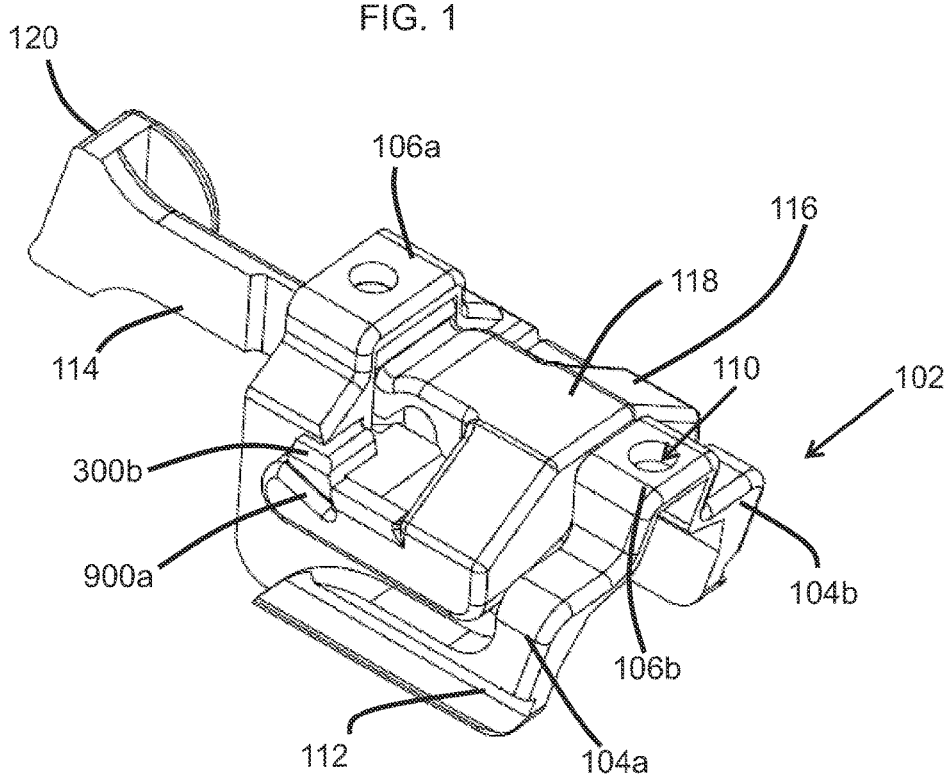
FIG. 2 illustrates a left-side isometric view of the modular firearm holster safety retention assembly shown in FIG. 1, in accordance with an embodiment of the present invention.
Figure 3:
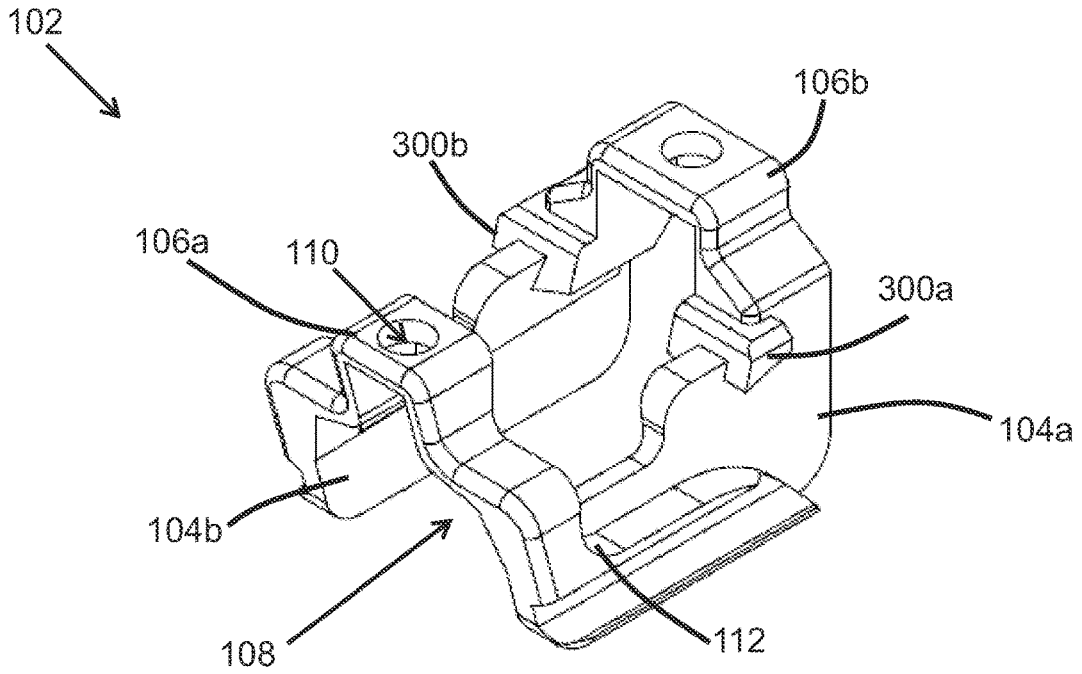
FIG. 3 illustrates an upper isometric view of an exemplary saddle, in accordance with an embodiment of the present invention.

In one aspect of the present invention, shown in FIG. 2, a modular firearm holster safety retention assembly 100, comprises:

- a saddle 102 comprising:
  - two sidewalk 104*a-b* joined together by a pair of spaced-apart bridges 106*a-b*, the walls and the bridges 106*a-b* being shaped and dimensioned to form a barrel passageway 108 to receive a barrel of a firearm, whereby an ejection port of the firearm is disposed between the bridges 106*a-b*; a pivot stop 112 disposed at one of the bridges 106*a-b*; a pair of saddle wedges 300*a-b* formed in the sidewalk 104*a-b;*
- a pivot release arm 114 detachably attachable to the saddle 102, the pivot release arm 114 comprising:
  - a first end 116 and a second end 120, the first end 116 comprising a platform 118 coupled between the bridges 106*a-b* of the platform 118, the platform 118 comprising a locking nub 1000 that aligns with and engages the ejection port of the firearm when the barrel sets in the barrel passageway 108, whereby the locking nub 1000 restricts the barrel of the firearm from disengaging from the barrel passageway 108, the second end 120 projecting away from the platform 118, whereby urging the second end 120 of the pivot release arm 114 to pivot away from the platform 118 disengages the locking nub 1000 from the ejection port of the firearm to enable the barrel of the firearm to disengage from the barrel passageway 108;

whereby the pivot stop 112 of the saddle 102 restricts the pivot distance of the pivot release arm 114; and a pair of arm wedges 900*a-b* formed in the first end 116 of the pivot release arm 114, adjacent to the platform 118, whereby the saddle wedges 300*a-b* and the arm wedges 900*a-b* engage when a torque is applied to the second end 120 of the pivot release arm 114.

In one aspect, the bridges 106*a-b* are defined by a fastening hole 110 in the central axis of the bridges 106*a-b*.

In one aspect, the platform 118 is defined by a central fastening hole 902.

In one aspect, the assembly 100 may also include a T-nut and a screw that pass through the fastening holes 110, 902 in the bridges 106*a-b* and the platform 118.

In one aspect, the assembly 100 is sized to retain multiple sizes and types of firearms.

In one aspect, the assembly 100 is fabricated from a Nylon Resin.

One objective of the present invention is to provide an assembly 100 that locks a firearm in place when inserted into a holster.

Another objective is to help mitigate torque on the pivot release arm 114 when force is applied.

Yet another objective is to restrict the pivot release arm 114 for overleveraging through a pivot stop 112.

An exemplary objective is to prevent a strong pulling force from forcefully removing firearm from holster through wedges that create a braking mechanism.

Additional objectives are to provide an inexpensive to manufacture modular firearm holster safety retention assembly 100.

Looking again at FIG. 1, the assembly 100 is a unique modular tool that works in conjunction holster of a firearm. The modular configuration provides a two-piece set up with a saddle 102 that is shaped and dimensioned to receive the barrel of a firearm in a snug relationship; and a corresponding pivot release arm 114 that has a locking nub 1000 that serves to lock the firearm into the saddle 102, and can also be manipulated to release the firearm from the saddle 102 (See FIG. 3). In one non-limiting embodiment, the assembly 100 is fabricated from a Nylon Resin. However, in other embodiments various resilient or semi-rigid materials may also be used for the saddle 102 and/or the pivot release arm 114. Other alternatively architectural arrangements are known to the inventor. For example, the assembly 100 can also be constructed by three or more pieces, not limiting into two-piece.

Figure 4:
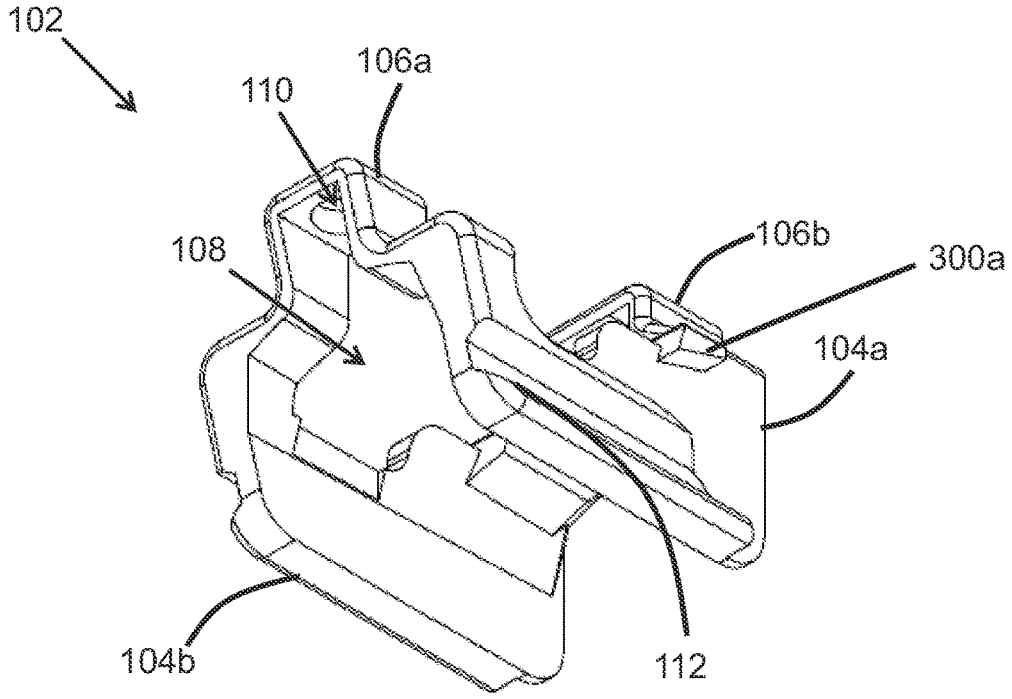
FIG. 4 illustrates a bottom isometric view of the saddle shown in FIG. 3, in accordance with an embodiment of the present invention.
Figure 5:
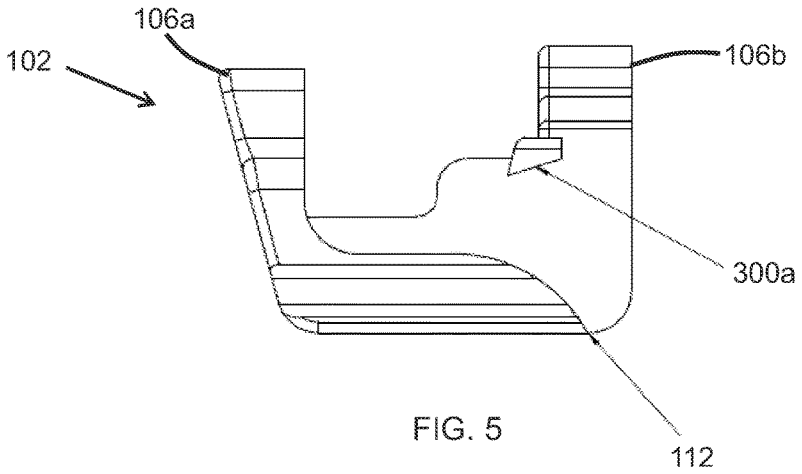
FIG. 5 illustrates a sectioned side view of the saddle shown in FIG. 3, in accordance with an embodiment of the present invention.

Looking now at FIG. 4, the assembly 100 comprises a saddle 102. The saddle 102 comprises two sidewalk 104*a-b* that are joined together by a pair of spaced-apart bridges 106*a-b*. As illustrated, the sidewalk 104*a-b* are vertical while the bridges 106*a-b* have a slightly arced disposition. The walls and the bridges 106*a-b* are shaped and dimensioned to form a barrel passageway 108 to receive a barrel of a firearm. The unique arc shape is illustrated in FIG. 5. In one embodiment, the saddle 102 is sized to retain multiple sizes and types of firearms.

For example, a short barrel firearm would have a saddle 102 with shorter sidewalls 104*a-b*, while a long firearm would have longer sidewalls 104*a-b* and the bridges 106*a-b* would be separated at a greater distance. When the firearm is fitted into the holster and the saddle 102, the ejection port of the firearm is disposed between the bridges 106*a-b*. This natural alignment of the ejection port being between the bridges 106*a-b* is necessary for locking the firearm into the saddle 102, as described below.

Figure 6:
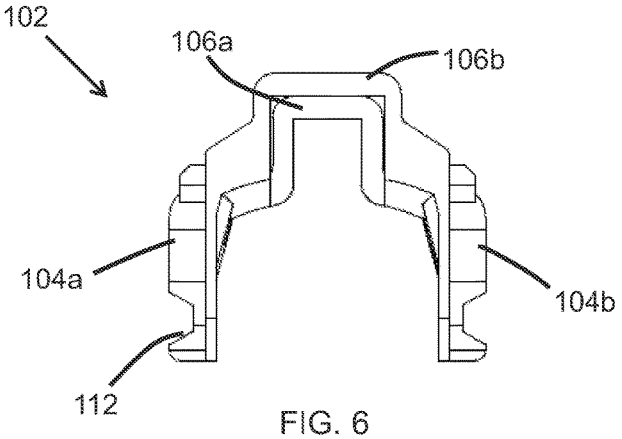
FIG. 6 illustrates a frontal view of the saddle shown in FIG. 3, in accordance with an embodiment of the present invention.
Figure 7:
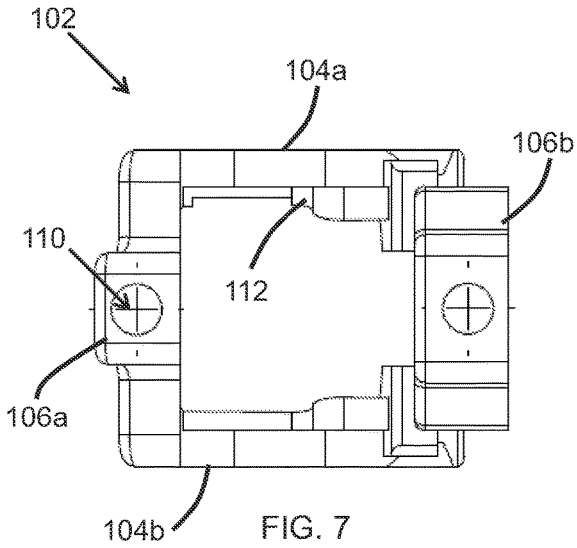
FIG. 7 illustrates a top view of the saddle shown in FIG. 3, in accordance with an embodiment of the present invention.

In one possible embodiment, shown in FIG. 6, a pivot stop 112 is disposed at one of the bridges 106*a-b*. As will be described below, the pivot stop 112 prevents the pivot leverage arm from overleveraging, or swinging too far when it is being used to release the firearm from the saddle 102. In another embodiment, shown ion FIG. 7, a pair of saddle wedges 300*a-b* form in both sides of the sidewalls 104*a-b*. The saddle wedges 300*a-b* work with a corresponding arm wedges 900*a-b*, described below, to prevent forceful removal of the firearm from the saddle 102.

Figure 8:
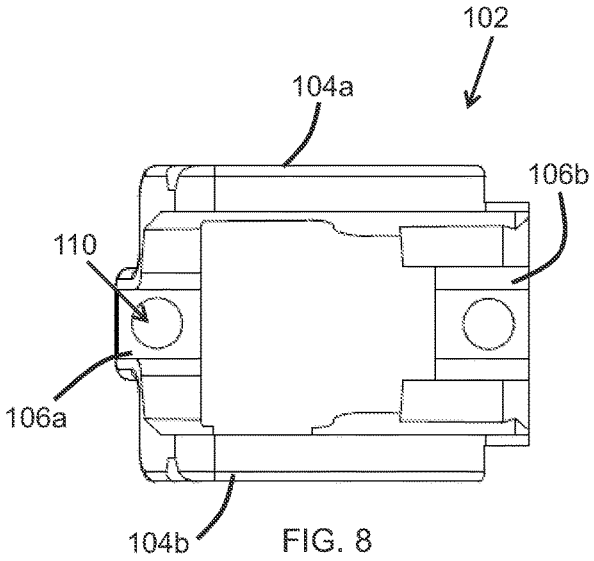
FIG. 8 illustrates a bottom view of the saddle shown in FIG. 3, in accordance with an embodiment of the present invention.

For example, a person grabs the butt of the firearm and pulls out forcefully. The wedges would create a braking mechanism as they interlock in a tight fit. As FIG. 8 illustrates, the bridges 106*a-b* can form a central fastening hole, which is used to fasten to the pivot release arm 114, as described below. A T-nut and screw combination, or other fastening mechanism may used to fasten the saddle 102 to the pivot release arm 114.

Figure 9:
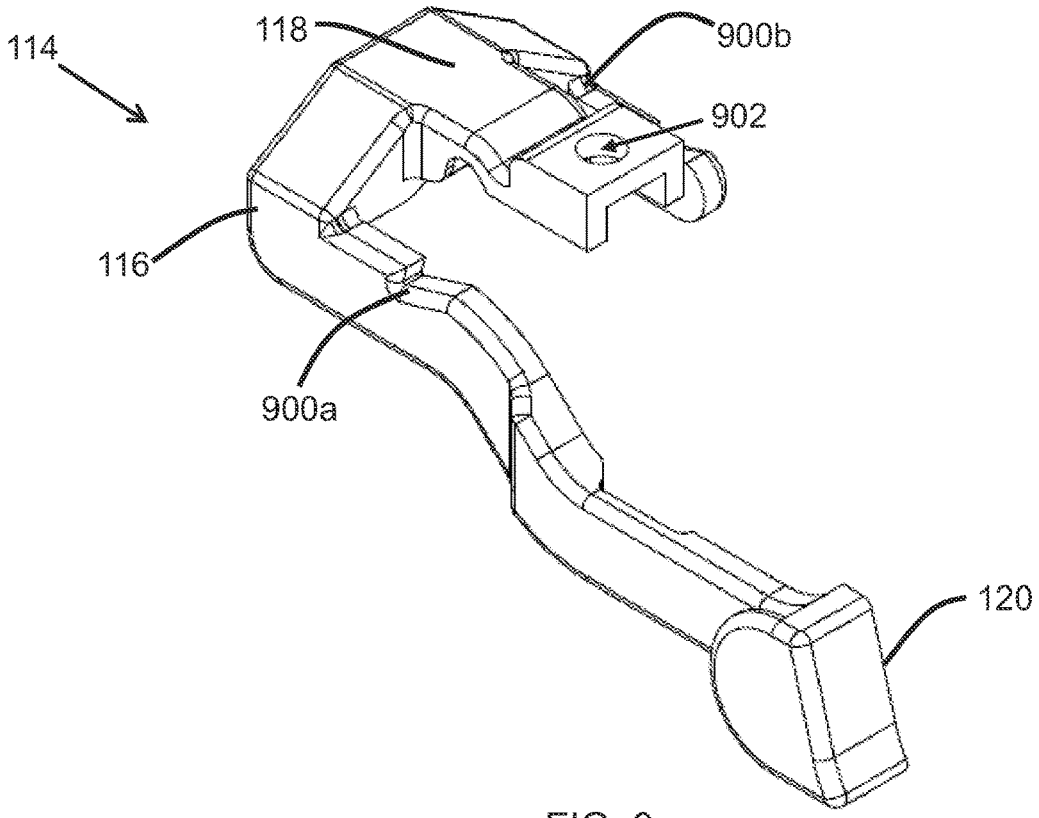
FIG. 9 illustrates an upper isometric view of an exemplary pivot release arm, in accordance with an embodiment of the present invention.

Looking now at FIG. 9, the second component of the modular design is an elongated pivot release arm 114 that detachably attaches to the saddle 102. The pivot release arm 114 has a locking nub 1000 that serves to lock the firearm into the saddle 102. The pivot release arm 114 may also be manipulated to release the firearm from the saddle 102. The locking nub 1000 is simply a protrusion that aligns with the ejection port of the firearm when the firearm is inserted into the saddle 102, such that the ejection port rests between the bridges 106*a-b*. The elongated configuration of the pivot release arm 114 allows it to serve as a lever; whereby swinging the pivot release arm 114 in a first direction, such as away from the saddle 102, the locking nub 1000 disengages from the ejection port, so as to release the firearm from the saddle 102.

Figure 10:
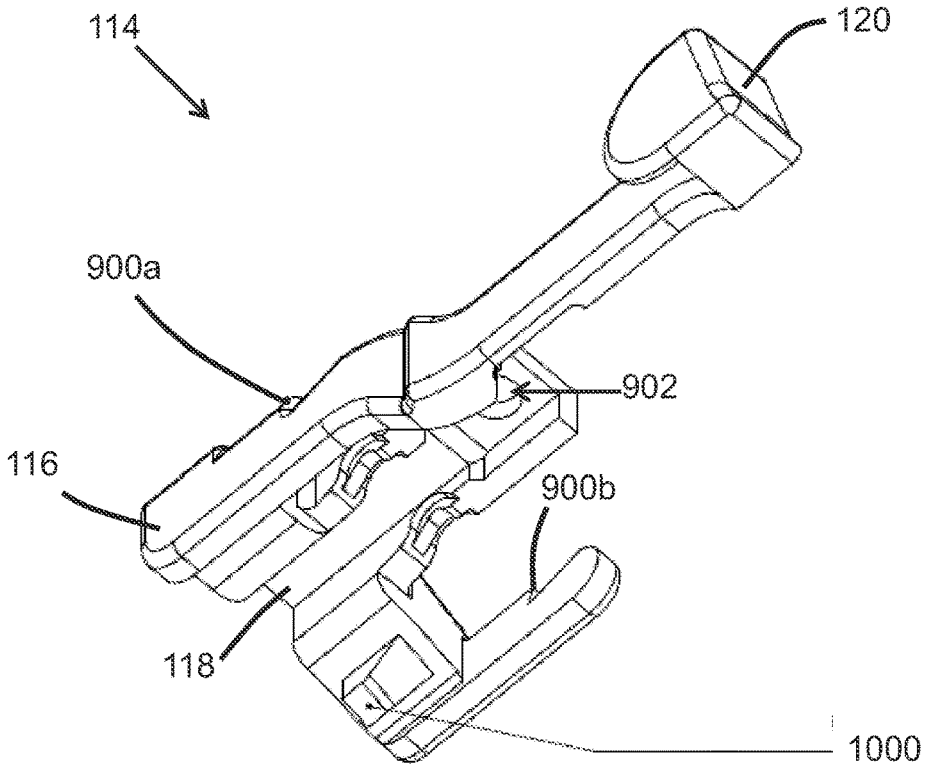
FIG. 10 illustrates a bottom isometric view of the pivot release arm shown in FIG. 9, in accordance with an embodiment of the present invention.

Turning now to FIG. 10, the pivot release arm 114 is defined by a first end 116 and an opposing second end 120. The first end 116 comprises a platform 118. The platform 118 is substantially horizontal, and is disposed to be coupled between the bridges 106*a-b* of the platform 118. In some embodiments, the platform 118 is defined by a central fastening hole. In some embodiments, the assembly 100 may also include a T-nut and a screw that pass through the fastening holes in the bridge and the platform 118.

Furthermore, the platform 118 is the section of the pivot release arm 114 that contains the locking nub 1000. As described above, the locking nub 1000 aligns with and engages the ejection port of the firearm when the barrel sets in the barrel passageway 108. In this manner, the locking nub 1000 restricts the barrel of the firearm from disengaging from the barrel passageway 108.

Figure 11:
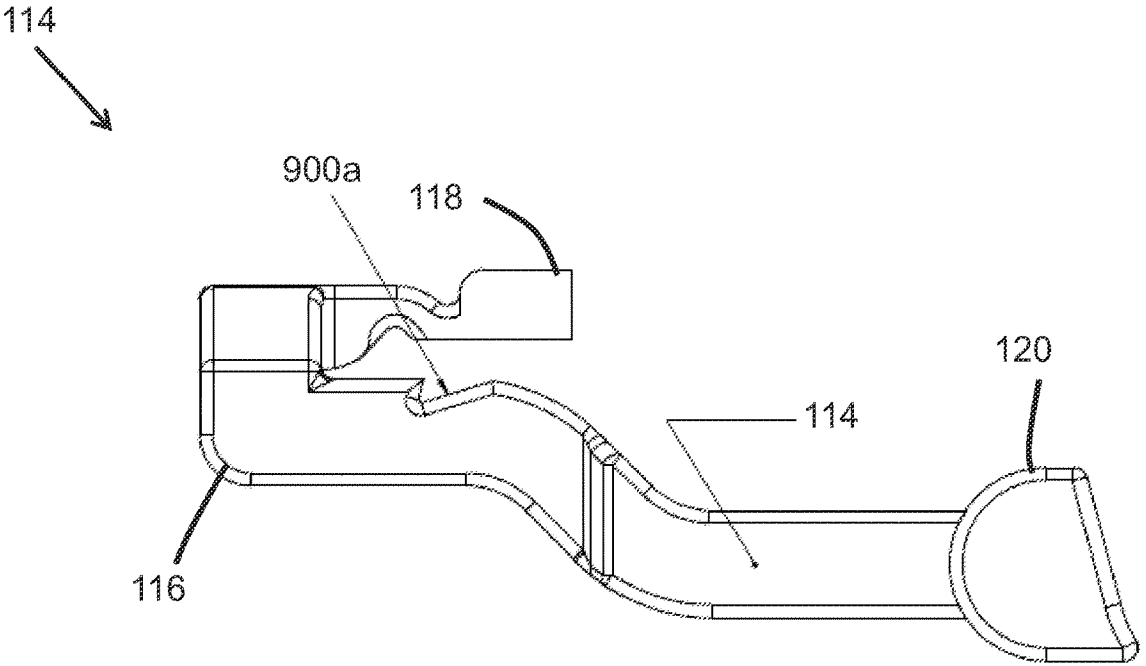
FIG. 11 illustrates an elevated side view of the pivot release arm shown in FIG. 9, in accordance with an embodiment of the present invention.

As FIG. 11 references, the second end 120 of the pivot release arm 114 projects away from the platform 118. The terminus of the second and may have a simple thumb rest that allows for easier manipulation of the pivot release arm 114. In operation, urging the second end 120 of the pivot release arm 114 to pivot away from the platform 118 disengages the locking nub 1000 from the ejection port of the firearm. This enables the barrel of the firearm to disengage from the barrel passageway 108. Thus, the second end

120 of the pivot release arm 114 serves as a lever, and the first end 116 of the pivot release arm 114 serves as a fulcrum. The lever is pulled to pry the locking nub 1000 away from the ejection port of the firearm so that the firearm can be released from the saddle 102.

As discussed above, the pivot stop 112 of the saddle 102 restricts the pivot distance of the pivot release arm 114. The pivot stop 112 is disposed in the path of the pivot release arm 114 so as to prevent the pivot release arm 114 from pivoting excessively when being pulled to release locking nub 1000. In one non-limiting embodiment, the pivot release arm 114 may be prevented from exceeding 3" pass the natural bias point.

Figure 12:
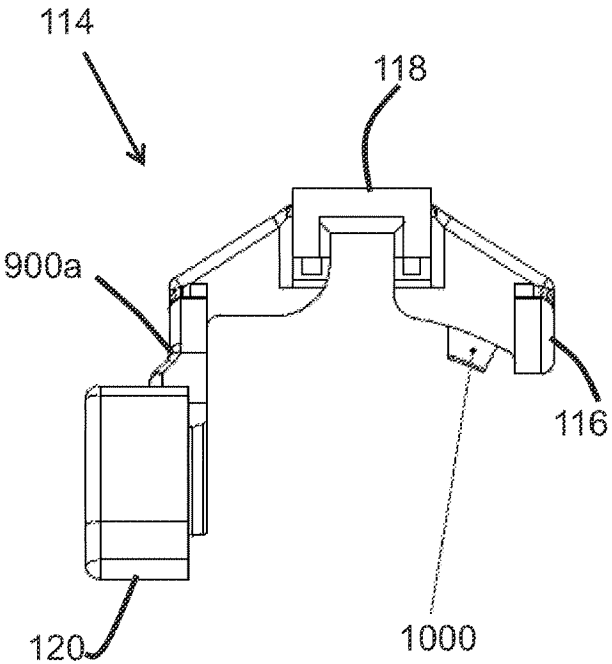
FIG. 12 illustrates a frontal view of the pivot release arm shown in FIG. 9, in accordance with an embodiment of the present invention.

As illustrated in FIG. 12, the assembly 100 also provides pair of arm wedges 900*a-b* that form in the first end 116 of the pivot release arm 114. The arm wedges 900*a-b* resemble notches in the first and of the pivot release arm 114, positioning slightly under and adjacent to the platform 118. In this positional arrangement, the arm wedges 900*a-b* are aligned with the saddle wedges 300*a-b*. The saddle wedge 300*a-b* and the arm wedge engage when a torque is applied to the second end 120 of the pivot release arm 114. Thereby, when the firearm is pulled abruptly out of the saddle 102, the arm wedges 900*a-b* and the saddle wedges 300*a-b* about each other creating a tight restrictive arrangement between the saddle 102 and the pivot release arm 114.

In operation, a firearm is oriented down the barrel pointed towards opening in the holster. The modular firearm holster safety retention assembly 100 is disposed in the holster in such a way that the barrel passageway of the saddle can receive the barrel. The barrel slides into the holster and stops at the saddle where the ejection port rests between the bridges of the saddle. The locking nub engages the open ejection port, so as to restrict movement. The pivot release arm can be pivoted in a first direction, such as away from the saddle, to disengage the locking nub from the ejection port of the firearm. A pivot stop in the saddle prevents the pivot release arm from over extending past a point. If a large amount of torque is applied to the firearm, such as someone trying to firearm out of the holster, the arm wedges and the saddle wedges interlock form a tight grip that restricts the firearm from being pulled from the holster.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What I claim is:

1. A modular firearm holster safety retention assembly, the assembly comprising:

a saddle comprising:

two sidewalk joined together by a pair of spaced-apart bridges, the walls and the bridges being shaped and dimensioned to form a barrel passageway to receive a barrel of a firearm, whereby an ejection port of the firearm is disposed between the bridges; a pivot stop disposed at one of the bridges; a pair of saddle wedges formed in the sidewalk; a pivot release arm detachably attachable to the saddle, the pivot release arm comprising: a first end and a second end, the first end comprising a platform coupled between the bridges of the saddle, the platform comprising a locking nub that aligns with and engages the ejection port of the firearm when the barrel sets in the barrel passageway, whereby the locking nub restricts the barrel of the firearm from disengaging from the barrel passageway, the second end projecting away from the platform, whereby urging the second end of the pivot release arm to pivot away from the platform disengages the locking nub from the ejection port of the firearm to enable the barrel of the firearm to disengage from the barrel passageway;

whereby the pivot stop of the saddle restricts the pivot distance of the pivot release arm; and a pair of arm wedges formed in the first end of the pivot release arm, adjacent to the platform, whereby the saddle wedge and the arm wedge engage when a torque is applied to the second end of the pivot release arm.

2. The assembly of claim 1, wherein the bridges are defined by a central hole that aligns with a fastening hole in the central axis of the bridges.

3. The assembly of claim 1, wherein the platform is defined by a central fastening hole.

4. The assembly of claim 1, further comprising a T-nut and a screw that pass through the fastening holes in the bridge and the platform.

5. The assembly of claim 1, wherein the assembly is sized to retain multiple sizes and types of firearms.

6. The assembly of claim 1, wherein the assembly is fabricated from a Nylon Resin.

* * * * *